US006606870B2

(12) United States Patent
Holmes et al.

(10) Patent No.: US 6,606,870 B2
(45) Date of Patent: Aug. 19, 2003

(54) DETERMINISTIC REFRIGERATOR DEFROST METHOD AND APPARATUS

(75) Inventors: John S. Holmes, Sellersburg, IN (US); Wolfgang Daum, Louisville, KY (US); Jerry J. Queen, II, New Albany, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/755,296

(22) Filed: Jan. 5, 2001

(65) Prior Publication Data

US 2002/0088238 A1 Jul. 11, 2002

(51) Int. Cl.[7] ..... F25D 21/06; F25B 47/02
(52) U.S. Cl. ..... 62/155; 62/154; 62/156
(58) Field of Search ..... 62/151, 152, 153, 62/154, 155, 156, 140, 234

(56) References Cited

U.S. PATENT DOCUMENTS

| | | | | |
|---|---|---|---|---|
| 3,453,837 A | * | 7/1969 | Sandstrom et al. | 62/156 X |
| 3,681,933 A | | 8/1972 | Check, Jr. | 62/156 |
| 3,839,878 A | | 10/1974 | Tilmanis | 62/155 |
| 3,992,895 A | | 11/1976 | Kramer | 62/155 |
| 4,104,888 A | | 8/1978 | Reedy et al. | 62/80 |
| 4,156,350 A | | 5/1979 | Elliott et al. | 62/80 |
| 4,173,871 A | | 11/1979 | Brooks | 62/80 |
| 4,251,988 A | | 2/1981 | Allard et al. | 62/80 |
| 4,297,852 A | | 11/1981 | Brooks | 62/153 |
| 4,327,556 A | | 5/1982 | Zampini et al. | 62/153 |
| 4,327,557 A | | 5/1982 | Clarke et al. | 62/153 |
| 4,344,294 A | | 8/1982 | Gelbard | 62/155 |
| 4,400,949 A | | 8/1983 | Kinoshita et al. | 62/140 |
| 4,481,785 A | | 11/1984 | Tershak et al. | 62/153 |
| 4,528,821 A | | 7/1985 | Tershak et al. | 62/153 |
| 4,555,057 A | | 11/1985 | Foster | 236/94 |

(List continued on next page.)

*Primary Examiner*—Harry B. Tanner
(74) *Attorney, Agent, or Firm*—H. Neil Houser, Esq.; Armstrong Teasdale LLP

(57) ABSTRACT

A defrost control system for a self-defrosting refrigerator is configured to monitor a compressor load, determine whether at least a first defrost cycle is required based on the compressor load, execute at least one defrost cycle when required; and regulate the defrost cycle to conserve energy. A controller is operatively coupled to a compressor, a defrost heater, and a refrigeration compartment temperature sensor. The controller makes defrost decisions based on temperature conditions in the refrigeration compartment in light of other events, such as refrigerator door openings, completed defrost cycles, and power up events. Defrost cycles are automatically adjusted as operating conditions change, thereby avoiding unnecessary energy consumption that would otherwise occur in a fixed defrost cycle.

32 Claims, 11 Drawing Sheets

U.S. PATENT DOCUMENTS

| | | | | |
|---|---|---|---|---|
| 4,604,871 | A | 8/1986 | Chiu et al. | 62/130 |
| 4,646,536 | A | 3/1987 | Yamada et al. | 62/234 |
| 4,663,941 | A | 5/1987 | Janke | 62/156 |
| 4,680,940 | A | 7/1987 | Vaughn | 62/155 |
| 4,689,965 | A | 9/1987 | Janke et al. | 62/155 |
| 4,694,657 | A | 9/1987 | Vaughn | 62/80 |
| 4,707,684 | A | 11/1987 | Janke et al. | 340/530 |
| 4,750,332 | A | 6/1988 | Jenski et al. | 62/80 |
| 4,834,169 | A | 5/1989 | Tershak et al. | 165/30 |
| 4,841,735 | A | 6/1989 | Oike | 62/126 |
| 4,887,436 | A | 12/1989 | Enomoto et al. | 62/155 |
| 4,938,027 | A | 7/1990 | Midlang | 62/80 |
| 4,949,550 | A | 8/1990 | Hanson | 62/126 |
| 5,123,253 | A | 6/1992 | Hanson et al. | 62/89 |
| 5,187,941 | A | 2/1993 | Tershak et al. | 62/89 |
| 5,231,844 | A | 8/1993 | Park | 62/80 |
| 5,251,454 | A | 10/1993 | Yoon | 62/156 |
| 5,363,667 | A | 11/1994 | Janke et al. | 62/131 |
| 5,363,669 | A | 11/1994 | Janke et al. | 62/155 |
| 5,369,962 | A | 12/1994 | Szynal et al. | 62/298 |
| 5,440,893 | A | 8/1995 | Davis et al. | 62/155 |
| 5,454,230 | A | 10/1995 | Janke et al. | 62/126 |
| 5,469,715 | A | 11/1995 | Janke et al. | 62/155 |
| 5,483,804 | A | 1/1996 | Ogawa et al. | 62/153 |
| 5,493,867 | A | 2/1996 | Szynal et al. | 62/80 |
| 5,533,350 | A | 7/1996 | Gromala et al. | 62/155 |
| 5,533,360 | A | 7/1996 | Szynal et al. | 62/298 |
| 5,564,286 | A | 10/1996 | Suse | 62/153 |
| 5,666,816 | A | 9/1997 | Jeong et al. | 62/154 |
| 5,673,565 | A | 10/1997 | Jeong et al. | 62/80 |
| 5,692,385 | A | 12/1997 | Hollenbeck et al. | 62/154 |
| 5,765,382 | A | 6/1998 | Manning et al. | 62/154 |
| 5,816,054 | A | 10/1998 | Yoo et al. | 62/80 |
| 5,842,355 | A | 12/1998 | Kalis et al. | 62/234 |
| 5,870,899 | A | 2/1999 | Choi | 62/155 |
| 5,887,443 | A | 3/1999 | Lee et al. | 62/153 |

* cited by examiner

FIG. 3B →

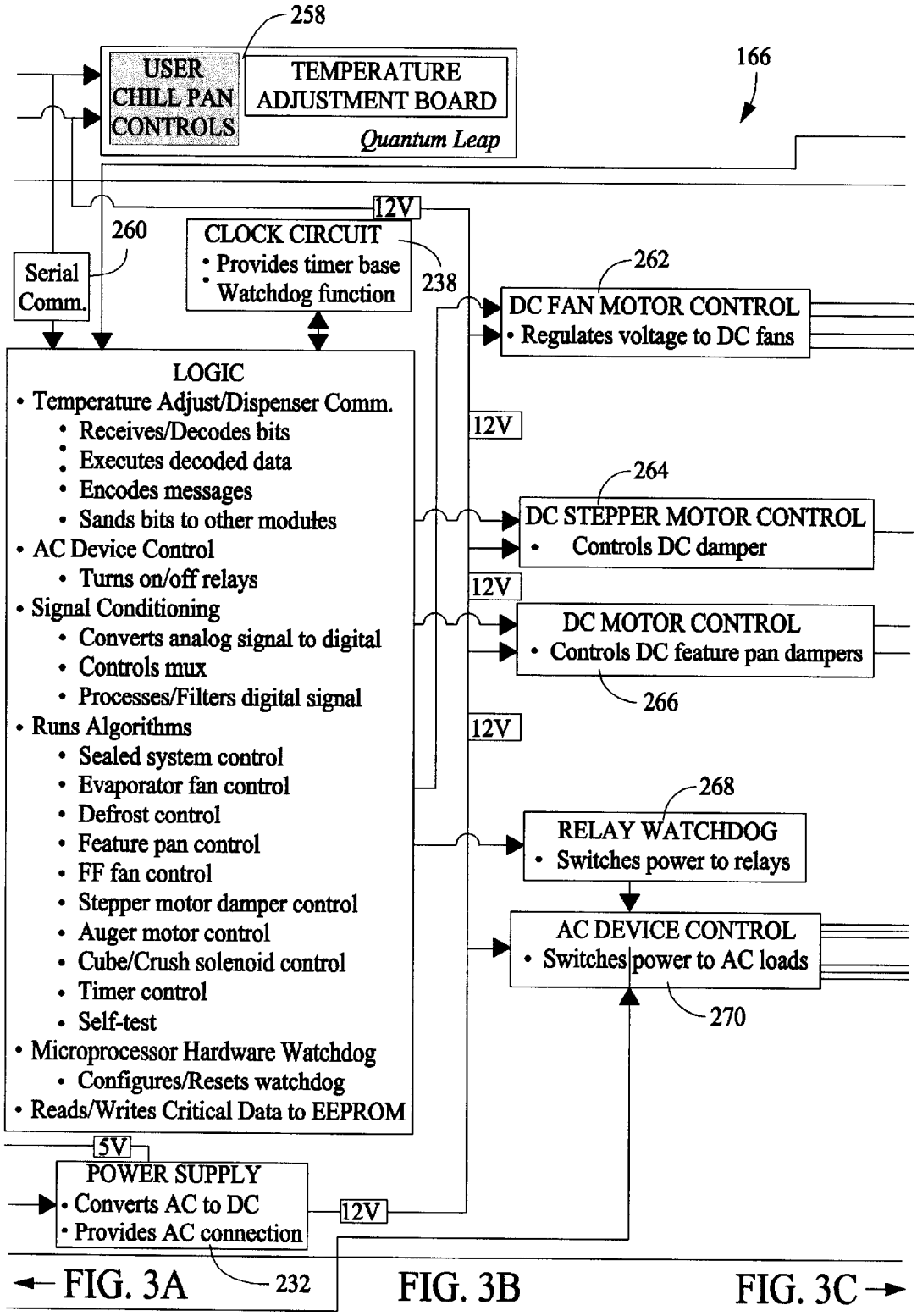
258
USER CHILL PAN CONTROLS
TEMPERATURE ADJUSTMENT BOARD
Quantum Leap
166
12V
260
CLOCK CIRCUIT
• Provides timer base
• Watchdog function
238
Serial Comm.
262
DC FAN MOTOR CONTROL
• Regulates voltage to DC fans
LOGIC
• Temperature Adjust/Dispenser Comm.
• Receives/Decodes bits
• Executes decoded data
• Encodes messages
• Sands bits to other modules
• AC Device Control
• Turns on/off relays
• Signal Conditioning
• Converts analog signal to digital
• Controls mux
• Processes/Filters digital signal
• Runs Algorithms
• Sealed system control
• Evaporator fan control
• Defrost control
• Feature pan control
• FF fan control
• Stepper motor damper control
• Auger motor control
• Cube/Crush solenoid control
• Timer control
• Self-test
• Microprocessor Hardware Watchdog
• Configures/Resets watchdog
• Reads/Writes Critical Data to EEPROM
12V
264
DC STEPPER MOTOR CONTROL
• Controls DC damper
12V
DC MOTOR CONTROL
• Controls DC feature pan dampers
266
12V
268
RELAY WATCHDOG
• Switches power to relays
AC DEVICE CONTROL
• Switches power to AC loads
270
5V
POWER SUPPLY
• Converts AC to DC
• Provides AC connection
12V
232
FIG. 3A
FIG. 3B
FIG. 3C

← FIG. 3B

Defrost Control State Diagram

1. Defrost algorithm reqests prechill from Sealed System algorithm.
2. Sealed system Indicates prechill complete, allows defrost to occur.
3. Defrost indicates defrost and dwell complete, continue with normal Sealed System operation.

DETERMINISTIC REFRIGERATOR DEFROST METHOD AND APPARATUS

BACKGROUND OF THE INVENTION

This invention relates generally to refrigerators and, more particularly, a method and apparatus for controlling refrigeration defrost cycles.

Known frost free refrigerators include a refrigeration defrost system to limit frost buildup on evaporator coils. An electromechanical timer is used to energize a heater after a pre-determined run time of the refrigerator compressor to melt frost buildup on the evaporator coils. To prevent overheating of the freezer compartment during defrost operations when the heater is energized, in at least one type of defrost system the compartment is pre-chilled. After defrost, the compressor is typically run for a predetermined time to lower the evaporator temperature and prevent food spoilage in the refrigerator and/or fresh food compartments of a refrigeration appliance.

Such timer-based defrost systems, however are not as energy efficient as desired. For instance, they tend to operate regardless of whether ice or frost is initially present, and they often pre-chill the freezer compartment regardless of initial compartment temperature. In addition, the defrost heater is typically energized without temperature regulation, and the compressor typically runs after a defrost cycle regardless of the compartment temperature. Such open loop defrost control systems, and the accompanying inefficiencies are undesirable in light of increasing energy efficiency requirements.

While efforts have been made to provide defrost on demand systems employing limited feedback, such as door openings and compressor and evaporator conditions, for improved energy efficiency of defrost cycles, an adaptive defrost on-demand system is desired to alter defrost operation to conserve energy in light of refrigerator operating conditions.

BRIEF SUMMARY OF THE INVENTION

In an exemplary embodiment of the invention, a defrost control system for a self-defrosting refrigerator is configured to monitor compressor load, determine whether at least a first defrost cycle is required based on the compressor load, execute at least one defrost cycle when required; and regulate the defrost cycle to conserve energy.

More specifically a controller is provided for a refrigerator including a compressor, a defrost heater, at least one refrigeration compartment and a temperature sensor thermally coupled to the refrigeration compartment. The controller is operatively coupled to the compressor, the defrost heater, and the temperature sensor, and makes defrost decisions based on temperature conditions in the refrigeration compartment in light of other events, such as refrigerator door openings, completed defrost cycles, and power up events. Defrost cycles are automatically adjusted as operating conditions change, thereby avoiding unnecessary energy consumption that would otherwise occur in a fixed defrost cycle.

BRIEF DESCRIPTION OF THE DRAWINGS

FIGS. 3A–3C is a block diagram of the main control board shown in FIG. 2;

DETAILED DESCRIPTION OF THE INVENTION

Figure 1:
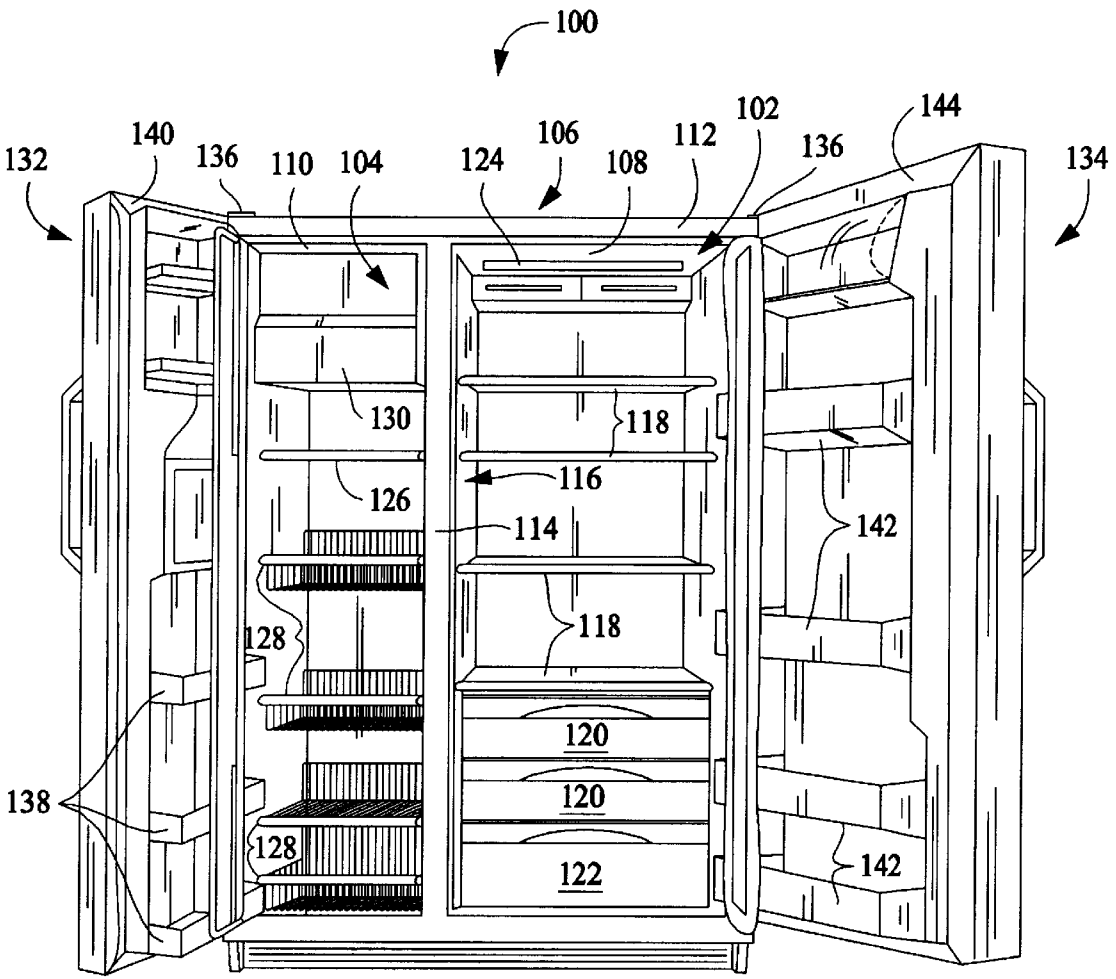
FIG. 1 is a perspective view of a refrigerator.

FIG. 1 illustrates a side-by-side refrigerator 100 in which the present invention may be practiced. It is recognized, however, that the benefits of the present invention apply to other types of refrigerators, freezers, and refrigeration appliances wherein frost free operation is desirable. Consequently, the description set forth herein is for illustrative purposes only and is not intended to limit the invention in any aspect.

Refrigerator 100 includes a fresh food storage compartment 102 and a freezer storage compartment 104. Freezer compartment 104 and fresh food compartment 102 are arranged side-by-side.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners 108, 110. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments 102, 104, and a spaced wall of liners 108, 110 separating compartments 102, 104, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown) and selectively controlled, together with other refrigerator features, by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown in FIG. 1), a condenser (not shown in FIG. 1), an expansion device (not shown in FIG. 1), and an evaporator (not shown in FIG. 1) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator subject to the following control scheme.

Figure 2:
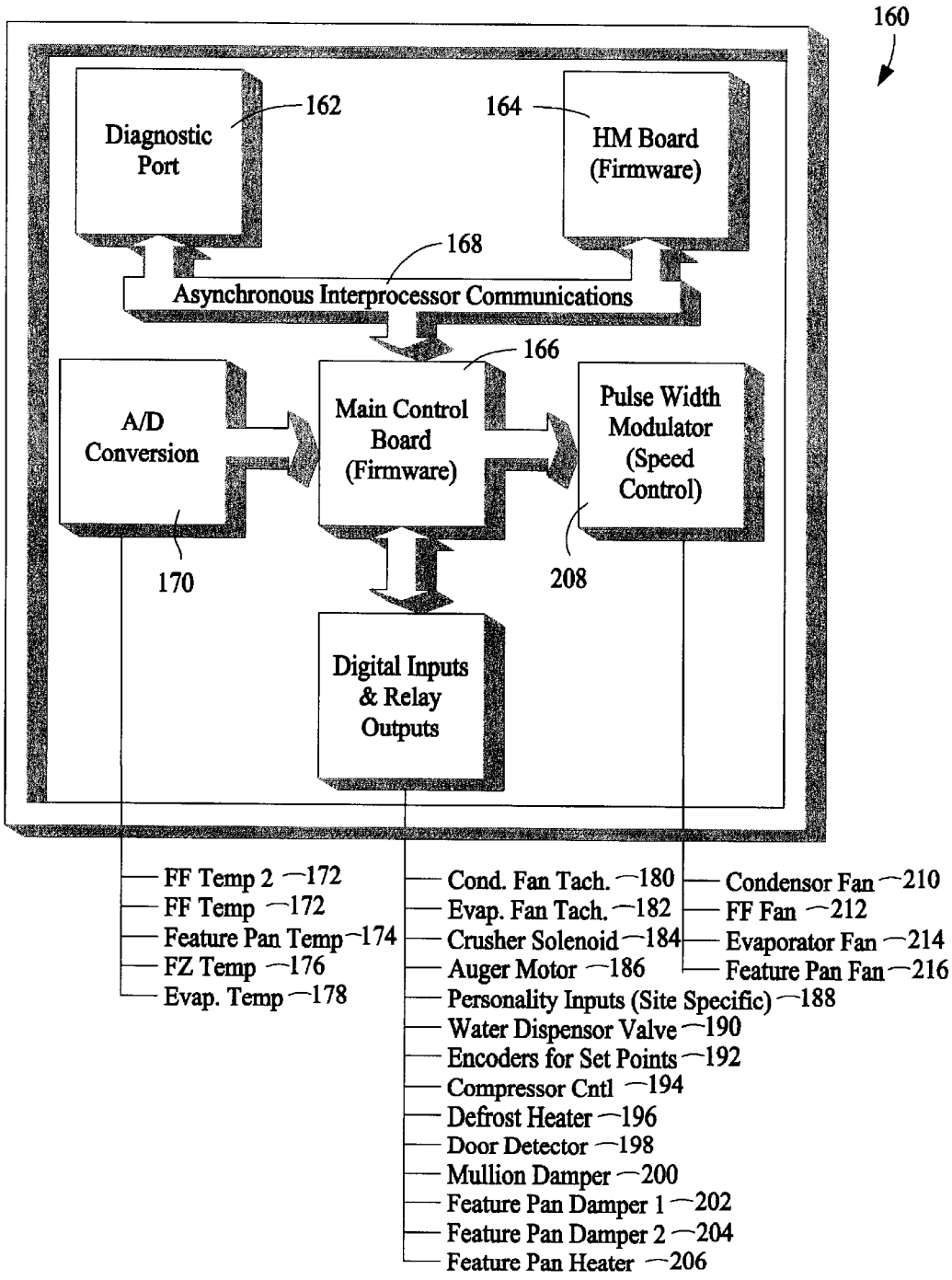
FIG. 2 is a block diagram of a refrigerator controller in accordance with one embodiment of the present invention.

FIG. 2 illustrates a controller 160 in accordance with one embodiment of the present invention. Controller 160 can be used, for example, in refrigerators, freezers and combinations thereof, such as, for example side-by-side refrigerator 100 (shown in FIG. 1).

Controller 160 includes a diagnostic port 162 and a human machine interface (HMI) board 164 coupled to a main control board 166 by an asynchronous interprocessor communications bus 168. An analog to digital converter ("A/D converter") 170 is coupled to main control board 166. A/D converter 170 converts analog signals from a plurality of sensors including one or more fresh food compartment temperature sensors 172, a quick chill/thaw feature pan (i.e., pan 122 shown in FIG. 1) temperature sensors 174 (shown in FIG. 8), freezer temperature sensors 176, external temperature sensors (not shown in FIG. 2), and evaporator temperature sensors 178 into digital signals for processing by main control board 166.

In an alternative embodiment (not shown), A/D converter 170 digitizes other input functions (not shown), such as a power supply current and voltage, brownout detection, compressor cycle adjustment, analog time and delay inputs (both use based and sensor based) where the analog input is coupled to an auxiliary device (e.g., clock or finger pressure activated switch), analog pressure sensing of the compressor sealed system for diagnostics and power/energy optimization. Further input functions include external communication via IR detectors or sound detectors, HMI display dimming based on ambient light, adjustment of the refrigerator to react to food loading and changing the air flow/pressure accordingly to ensure food load cooling or heating as desired, and altitude adjustment to ensure even food load cooling and enhance pull-down rate of various altitudes by changing fan speed and varying air flow.

Digital input and relay outputs correspond to, but are not limited to, a condenser fan speed 180, an evaporator fan speed 182, a crusher solenoid 184, an auger motor 186, personality inputs 188, a water dispenser valve 190, encoders 192 for set points, a compressor control 194, a defrost heater 196, a door detector 198, a mullion damper 200, feature pan air handler dampers 202, 204, and a quick chill/thaw feature pan heater 206. Main control board 166 also is coupled to a pulse width modulator 208 for controlling the operating speed of a condenser fan 210, a fresh food compartment fan 212, an evaporator fan 214, and a quick chill system feature pan fan 216.

Figure 3A:
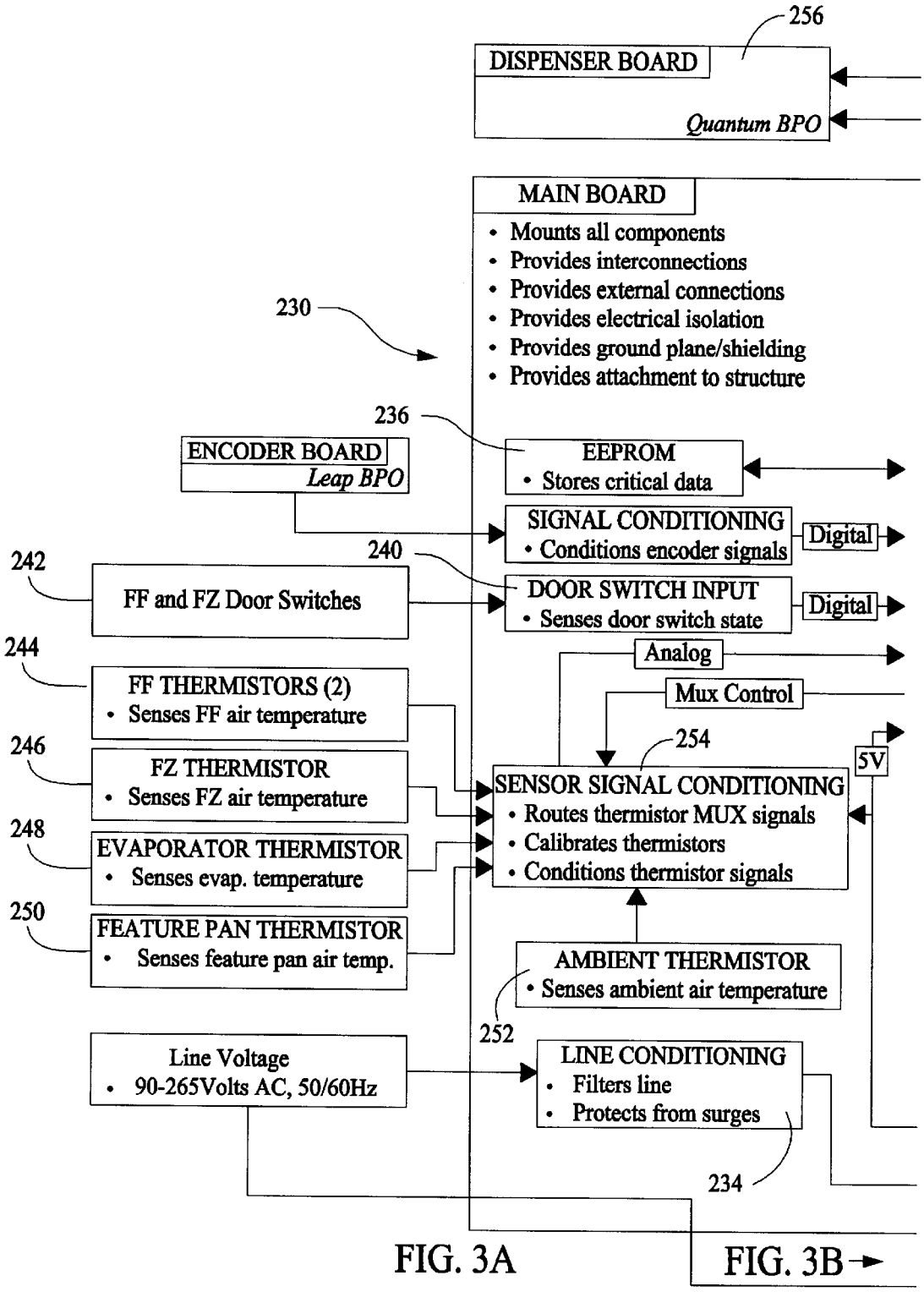
Figure 3C:
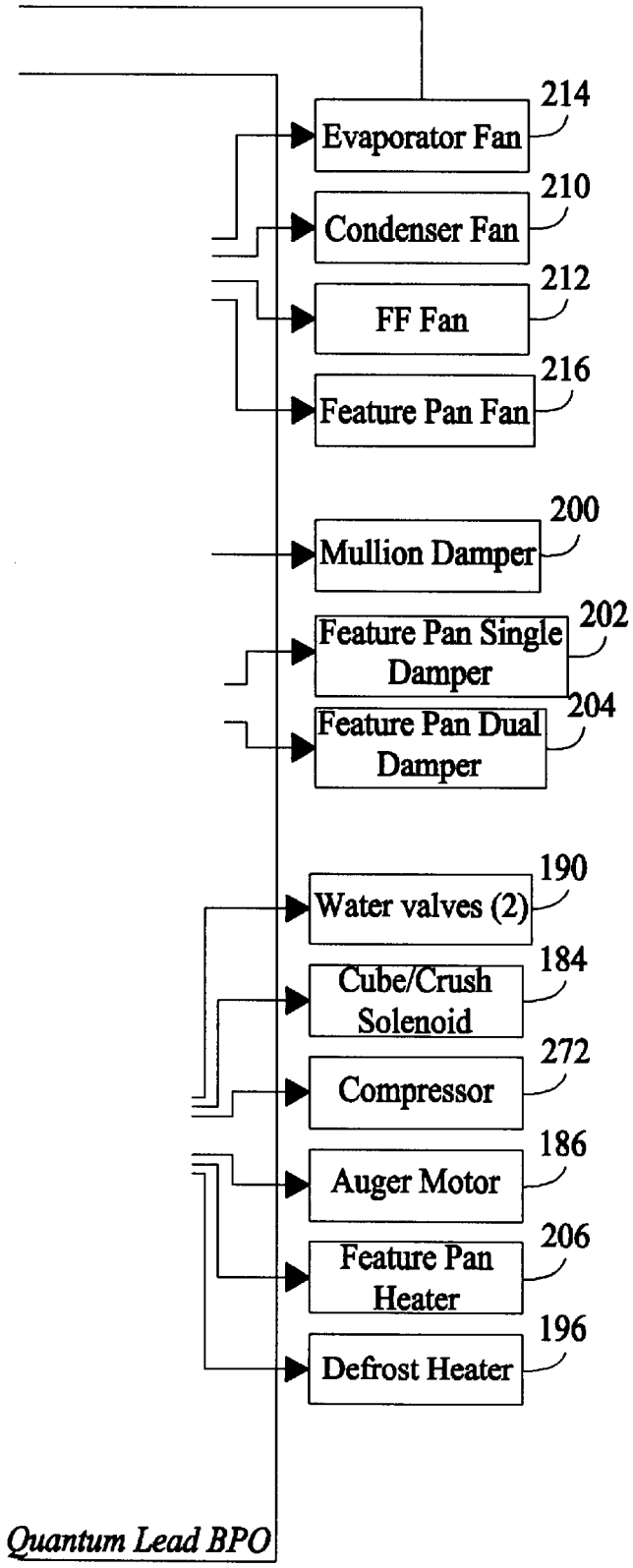
Figure 4:
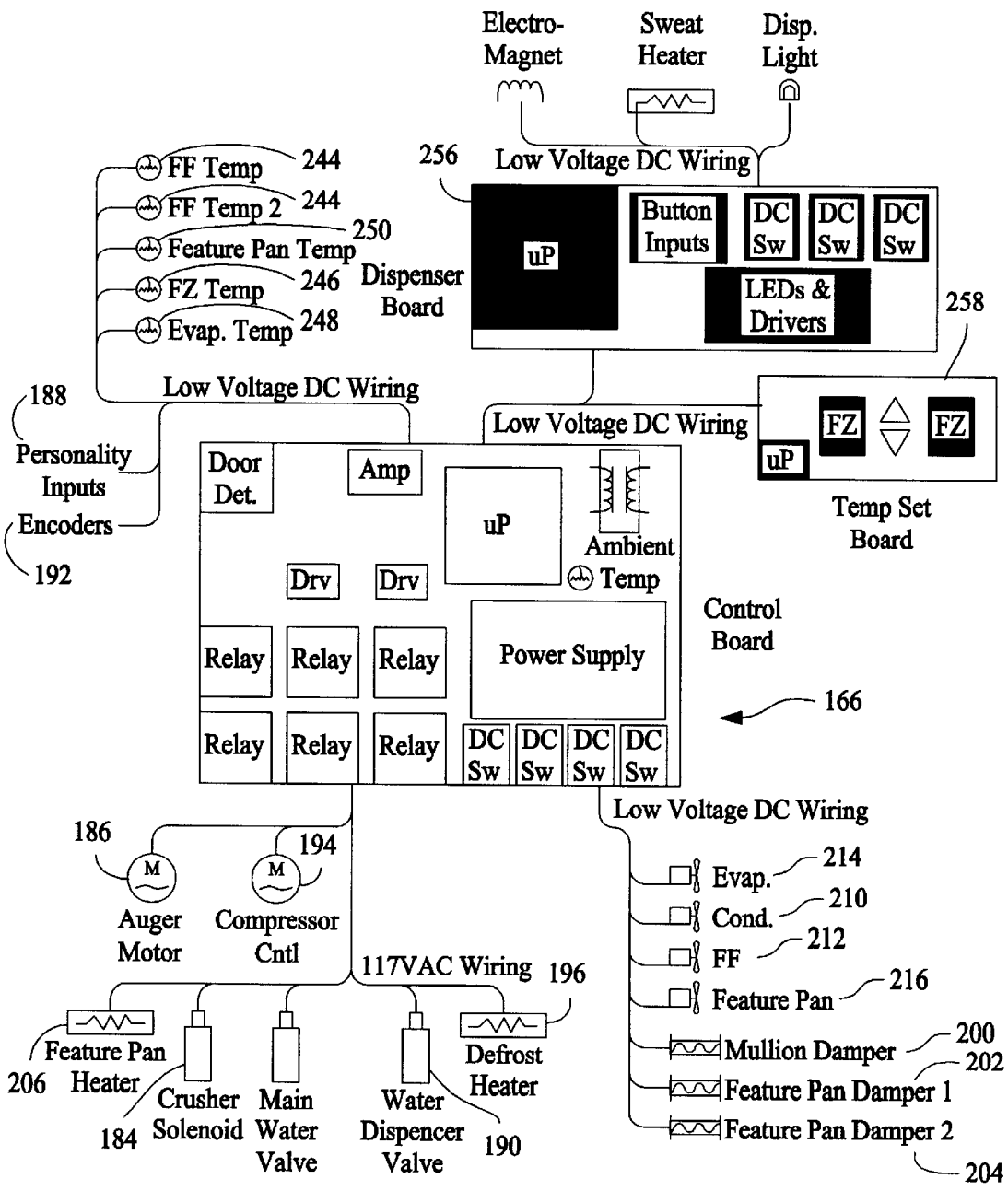
FIG. 4 is a block diagram of the main control board shown in FIG. 2.

FIGS. 3 and 4 are more detailed block diagrams of main control board 166. As shown in FIGS. 3 and 4, main control board 166 includes a processor 230. Processor 230 performs temperature adjustments/dispenser communication, AC device control, signal conditioning, microprocessor hardware watchdog, and EEPROM read/write functions. In addition, processor 230 executes many control algorithms including sealed system control, evaporator fan control, defrost control, feature pan control, fresh food fan control, stepper motor damper control, water valve control, auger motor control, cube/crush solenoid control, timer control, and self-test operations.

Processor 230 is coupled to a power supply 232 which receives an AC power signal from a line conditioning unit 234. Line conditioning unit 234 filters a line voltage which is, for example, a 90–265 Volts AC, 50/60 Hz signal Processor 230 also is coupled to an EEPROM 236 and a clock circuit 238.

A door switch input sensor 240 is coupled to fresh food and freezer door switches 242, and senses a door switch state. A signal is supplied from door switch input sensor 240 to processor 230, in digital form, indicative of the door switch state. Fresh food thermistors 244, a freezer thermistor 246, at least one evaporator thermistor 248, a feature pan thermistor 250, and an ambient thermistor 252 are coupled to processor 230 via a sensor signal conditioner 254. Conditioner 254 receives a multiplex control signal from processor 230 and provides analog signals to processor 230 representative of the respective sensed temperatures. Processor 230 also is coupled to a dispenser board 256 and a temperature adjustment board 258 via a serial communications link 260. Conditioner 254 also calibrates the above-described thermistors 244, 246, 248, 250, and 252.

Processor 230 provides control outputs to a DC fan motor control 262, a DC stepper motor control 264, a DC motor control 266, and a relay watchdog 268. Watchdog 268 is coupled to an AC device controller 270 that provides power to AC loads, such as to water valve 190, cube/crush solenoid 184, a compressor 272, auger motor 186, a feature pan heater 206, and defrost heater 196. DC fan motor control 266 is coupled to evaporator fan 214, condenser fan 210, fresh food fan 212, and feature pan fan 216. DC stepper motor control 266 is coupled to mullion damper 200, and DC motor control 266 is coupled to one of more sealed system dampers.

Processor logic uses the following inputs to make control decisions:

Freezer Door State—Light Switch Detection Using Optoisolators,

Fresh Food Door State—Light Switch Detection Using Optoisolators,

Freezer Compartment Temperature—Thermistor,

Evaporator Temperature—Thermistor,

Upper Compartment Temperature in FF—Thermistor,

Lower Compartment Temperature in FF—Thermistor,

Zone (Feature Pan) Compartment Temperature—Thermistor,

Compressor On Time,

Time to Complete a Defrost,

User Desired Set Points via Electronic Keyboard and Display or Encoders,

User Dispenser Keys,

Cup Switch on Dispenser, and

Data Communications Inputs.

The electronic controls activate the following loads to control the refrigerator:

Multi-speed or variable speed (via PWM) fresh food fan,

Multi-speed (via PWM) evaporator fan,

Multi-speed (via PWM) condenser fan,

Single-speed zone (Special Pan) fan,

Compressor Relay,

Defrost Relay,

Auger motor Relay,

Water valve Relay,

Crusher solenoid Relay,

Drip pan heater Relay,

Zonal (Special Pan) heater Relay,

Mullion Damper Stepper Motor IC,

Two DC Zonal (Special Pan) Damper H-Bridges, and

Data Communications Outputs.

Figure 5:
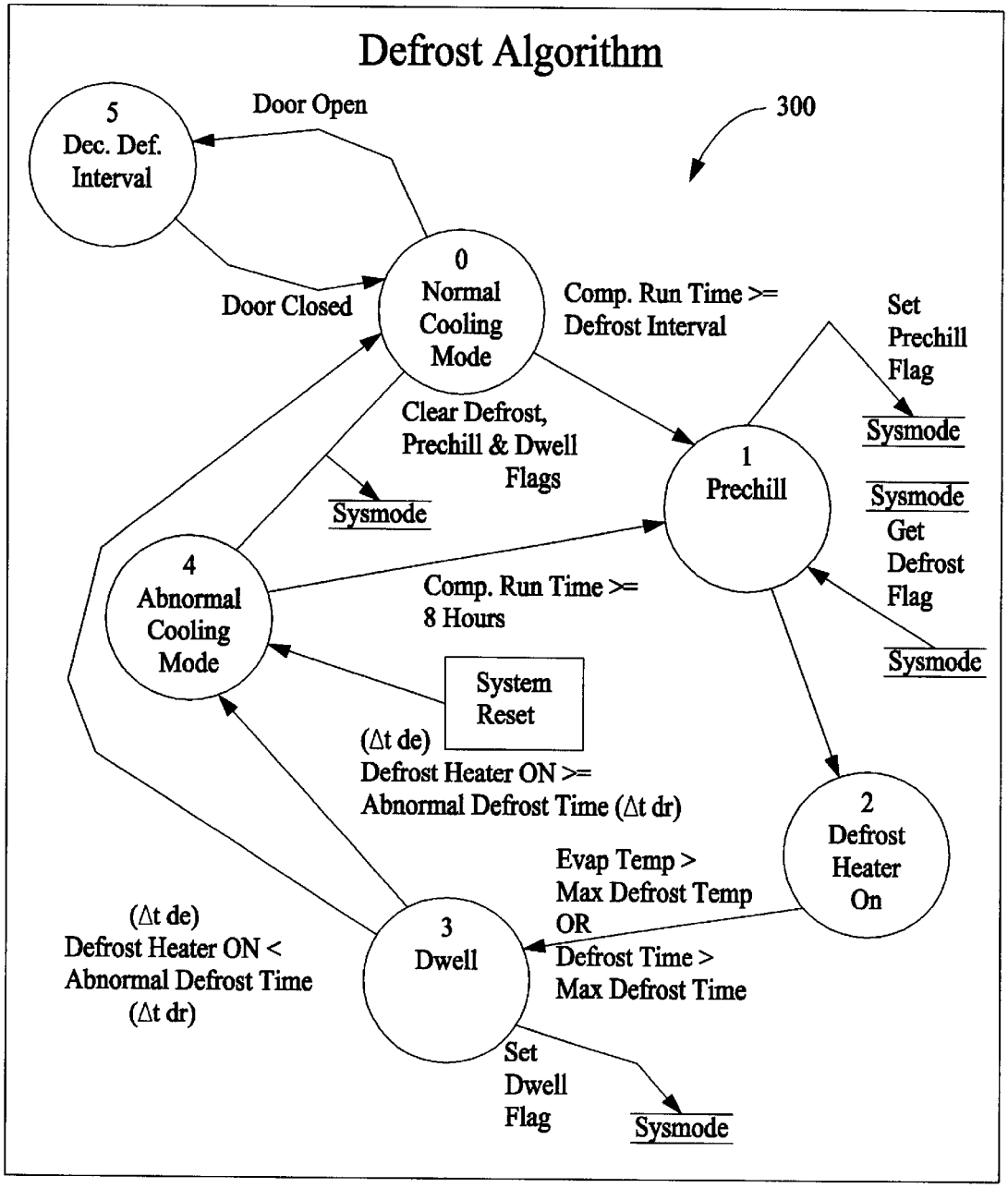
FIG. 5 is a defrost state diagram executable by a state machine of the controller shown in FIG. 2.

The foregoing functions of the above-described electronic control system are performed under the control of firmware implemented as small independent state machines FIG. 5 is a defrost state diagram 300 illustrating a state algorithm executable by a state machine of controller 160 (shown in FIGS. 2–4). As will be seen, controller 160 adaptively determines an optimal defrost state based upon effectiveness of defrost cycles as they occur, while accounting for power losses that may interrupt a defrost operation.

By monitoring evaporator temperature over time, it is determined whether defrost cycles are deemed "normal" or "abnormal." More specifically, when it is time to defrost, i.e. after an applicable defrost interval (explained below) has expired, the refrigerator sealed system is shut off, defrost heater 196 is turned on (at state 2), and a defrost timer is started. As the evaporator coils defrost, the temperature of the evaporator increases. When evaporator temperature reaches a termination temperature (60° F. in an exemplary embodiment) defrost heater 196 is shut off and the elapsed time defrost heater was on ($\Delta t_{de}$) is recorded in system memory. Also, if the termination temperature is not reached within a predetermined maximum time, defrost heater 196 is shut off and the elapsed time the defrost heater was on is recorded in system memory.

The elapsed defrost time $\Delta t_{de}$ is then compared with a predetermined defrost reference time $\Delta t_{dr}$ representative of, for example, an empirically determined or calculated elapsed defrost heater time to remove a selected amount of frost buildup on the evaporator coils that is typically encountered in the applicable refrigerator platform under predetermined usage conditions. If elapsed defrost time $\Delta t_{de}$ is greater than reference time $\Delta t_{dr}$, thereby indicating excessive frost buildup, a first or "abnormal" defrost interval, or time until the next defrost cycle, is employed If elapsed defrost time $\Delta t_{de}$ is less than reference time $\Delta t_{dr}$, a second or "normal" defrost interval, or time until the next defrost cycle is employed. The normal and abnormal defrost intervals, as defined below, are selectively employed, using $\Delta t_{dr}$ as a baseline, for more efficient defrost operation as refrigerator usage conditions change, thereby affecting frost buildup on the evaporator coils.

More specifically, the following control scheme automatically cycles between the first or abnormal defrost interval and the second or normal defrost interval on demand. When usage conditions are heavy and refrigerator doors 132, 134 (shown in FIG. 1) are opened frequently, thereby introducing more humidity into the refrigeration compartment, the system tends to execute the first or abnormal defrost interval repeatedly. When usage conditions are light and the doors opened infrequently, thereby introducing less humidity into the refrigeration compartments, the system tends to execute the second or normal defrost interval repeatedly. In intermediate usage conditions the system alternates between one or more defrost cycles at the first or abnormal defrost interval and one or more defrost cycles at the second or normal defrost interval.

Upon powerup, controller 160 reads freezer thermistor 246 (shown in FIG. 3) over a predetermined period of time and averages temperature data from freezer thermistor 146 to reduce noise in the data. If the freezer temperature is determined to be substantially at or below a set temperature, thereby indicating a brief power loss, a defrost interval is read from EEPROM memory 236 (shown in FIG. 3) of controller 160, and defrost continues from the point of power failure without resetting defrost parameters. Periodically, controller 160 saves a current time till defrost value in system memory in the event of power loss. Controller 160 therefore recovers from brief power loses and associated defrost cycles due to resetting of the system from momentary power failures are therefore avoided.

If freezer temperature data indicates that freezer compartment 104 (shown in FIG. 1) is warm, i.e., at a temperature outside a normal operating range of freezer compartment, humid air is likely to be contained in freezer compartment 104, either because of a sustained power outage or opened doors during a power outage. Because of the humid air, a defrost timer is initially set to the first or abnormal defrost interval. In one embodiment the first or abnormal defrost interval is set to, for example, eight hours of compressor run time. For each second of compressor run time, the first defrost interval is decremented by a predetermined amount, such as one second, and the first defrost interval is generally unaffected by any other event, such as opening and closing of fresh food and freezer compartment doors 134, 132. In alternative embodiments, a first or abnormal defrost interval of greater or lesser than eight hours is employed, and decrement values of greater or lesser than one second are employed for optimal performance of a particular compressor system in a particular refrigerator platform.

When the first defrost interval has expired, controller 160 runs compressor 272 (see FIG. 3) for a designated pre-chill period or until a designated pre-chill temperature is reached (at state 1). Defrost heater 196 (shown in FIGS. 2–4) is energized (at state 2) to defrost the evaporator coils. Defrost heater 196 is turned on to defrost the evaporator coils either until a predetermined evaporator temperature has been reached or until a predetermined maximum defrost time has expired, and then a dwell state is entered (at state 3) wherein operation is suspended for a predetermined time period.

Upon completion of an "abnormal" defrost cycle after the first or abnormal defrost interval has expired, controller 160 (at state 0) sets the time till defrost to the second or normal pre-selected defrost interval that is different from the first or abnormal time to defrost. Therefore, using the second defrost interval, a "normal" defrost cycle is executed. For example, in one embodiment, the second defrost interval is set to about 60 hours of compressor run time. In alternative embodiments, a second defrost interval of greater or lesser than 60 hours is employed to accommodate different refrigerator platforms, e.g., top-mount versus side-by-side refrigerators or refrigerators of varying cabinet size.

In one embodiment, the second defrost interval, unlike the first defrost interval, is decremented (at state 5) upon the occurrence of any one of several decrement events. For example, the second defrost interval is decremented (at state 5) by, for example, one second for each second of compressor run time. In addition, the second defrost interval is decremented by a predetermined amount, e.g., 143 seconds, for every second freezer door 132 (shown in FIG. 1) is open as determined by a freezer door switch or sensor 242 (shown in FIG. 3). Finally, the second defrost interval is decremented by a predetermined amount, such as 143 seconds in an exemplary embodiment, for every second fresh food door 134 (shown in FIG. 1) is open. In an alternative embodiment, greater or lesser decrement amounts are employed in place of the above-described one second decrement for each second of compressor run time and 143 second decrement per second of door opening. In a further alternative embodiment, the decrement values per unit time of opening of doors 132, 134 are unequal for respective door open events. In further alternative embodiments, greater or fewer than three decrement events are employed to accommodate refrigerators and refrigerator appliances having greater or fewer numbers of doors and to accommodate various compressor systems and speeds.

When the second or normal defrost interval has expired, controller 160 runs compressor 272 for a designated pre-chill period or until a designated pre-chill temperature is reached (at state 1). Defrost heater 196 is energized (at state 2) to defrost the evaporator coils. Defrost heater 196 is turned on to defrost the evaporator coils either until a predetermined evaporator temperature has been reached or until a predetermined maximum defrost time has expired. Defrost heater 196 is then shut off and the elapsed time defrost heater 196 was on ($\Delta t_{de}$) is recorded in system memory. A dwell state is then entered (at state 3) wherein operation is suspended for a predetermined time period.

The elapsed defrost time $\Delta t_{de}$ is then compared with a predetermined defrost reference time $\Delta t_{dr}$. If elapsed defrost time $\Delta t_{de}$ time is greater than reference time $\Delta t_{dr}$, thereby indicating excessive frost buildup, the first or abnormal defrost interval is employed for the next defrost cycle. If elapsed defrost time $\Delta t_{de}$ is less than reference time $\Delta t_{dr}$, the second or normal defrost interval is employed for the next defrost cycle. The applicable defrost interval is applied and a defrost cycle is executed when the defrost interval expires. The elapsed defrost time $\Delta t_{de}$ of the cycle is recorded and compared to reference time $\Delta t_{dr}$ to determine the applicable defrost interval for the next cycle, and the process continues. Normal and abnormal defrost intervals are therefore selectively employed on demand in response to changing refrigerator conditions.

Figure 6:
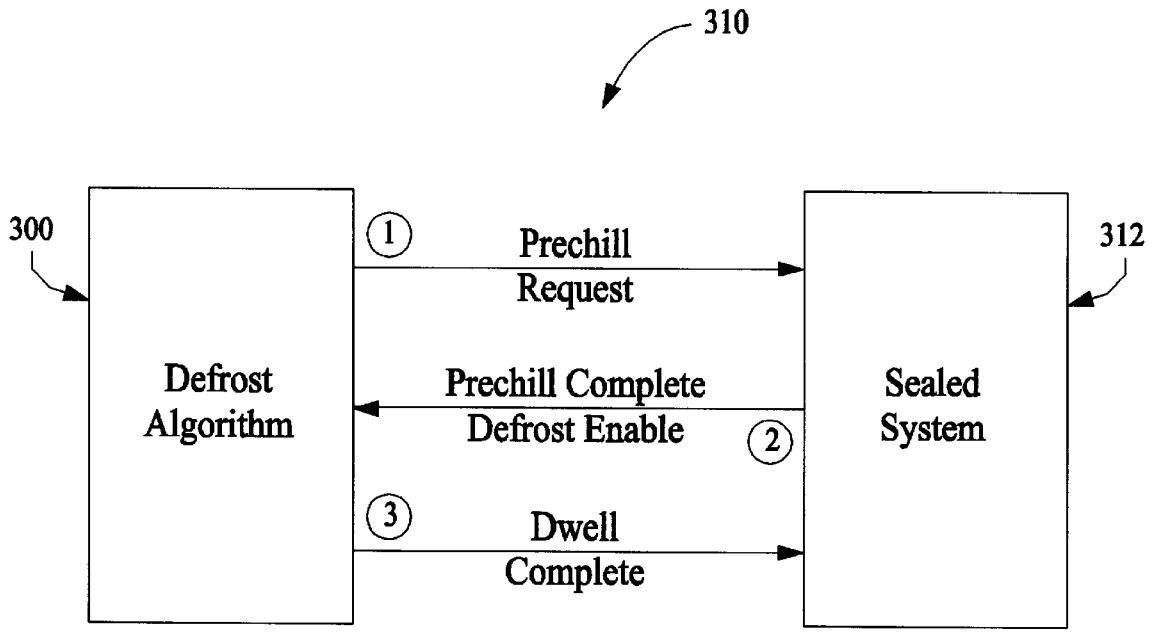
FIG. 6 is a sealed system/defrost system block diagram.
Figure 7:
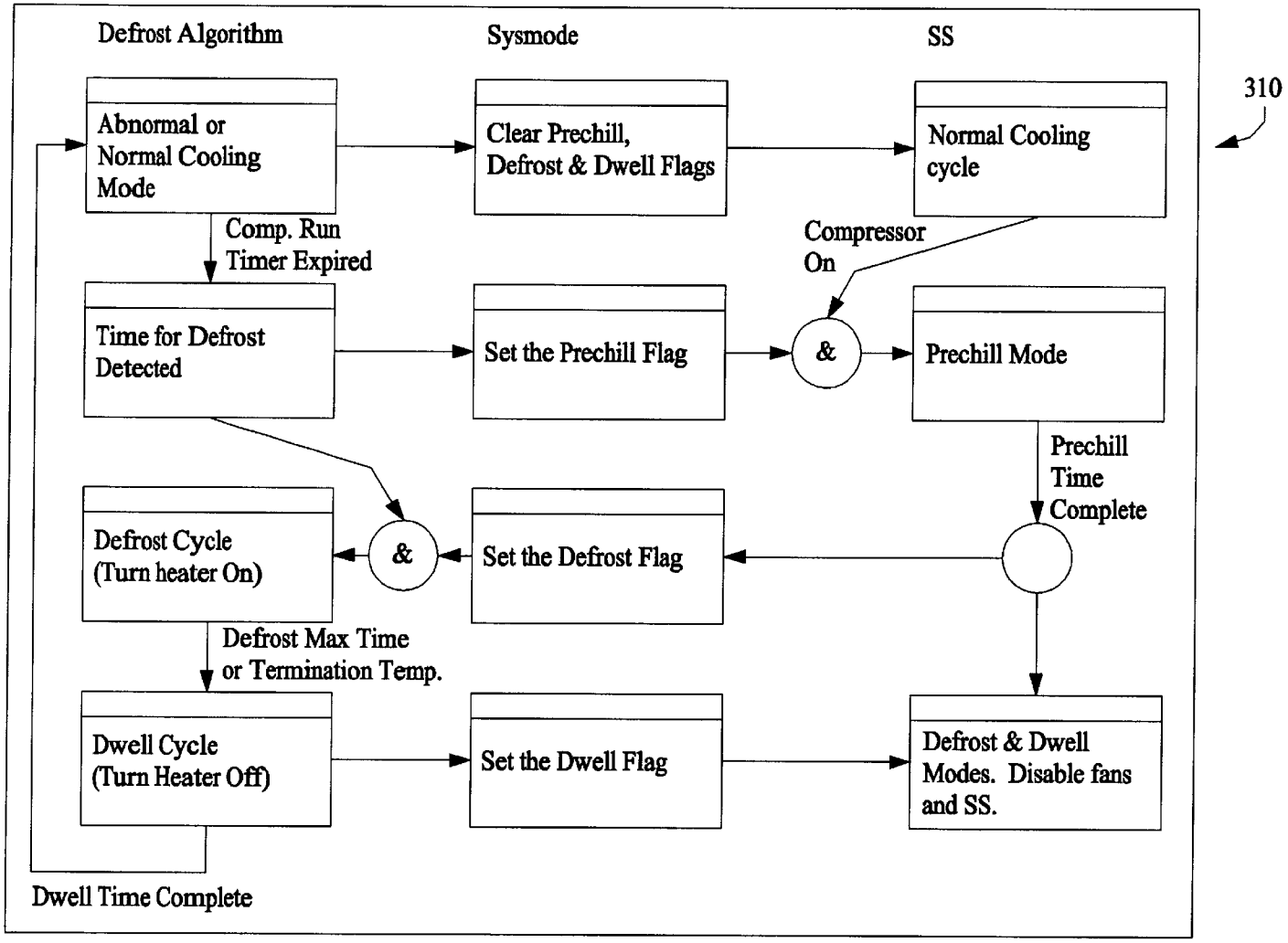
FIG. 7 is a defrost algorithm flow chart.

Because the defrost function introduces heat to the system and the sealed system provides cold air, it is desirable that the sealed system and defrost system do not negatively interact. Therefore, a defrost system/sealed system interaction algorithm 310 is defined as follows, and as illustrated in FIGS. 6 and 7.

Defrost algorithm 300, as described above, determines when it is time to begin the defrost process, and in one embodiment further includes a defrost cycle hold-off or delay. In an exemplary embodiment, refrigerator compartment doors 132, 134 (shown in FIG. 1) are to be closed for at a least a predetermined time period, such as two hours, before freezer compartment pre-chill is initiated prior to actual defrost. If the predetermined door closed time, e.g., two hours, is not satisfied, the hold-off will wait until the door closed condition is satisfied, up to a predetermined maximum time, such as, for example, sixteen hours after the originally desired pre-chill entry time determined by defrost algorithm 300. When either the door closed condition is satisfied or when the predetermined maximum time has expired, pre-chill operation is entered Hold-off timing values, including but not limited to the above-described values, may be stored in ROM, EEPROM 236 (shown in FIG. 3), or other programmable memory in order to accommodate the needs of different styles of refrigerator units.

When defrost algorithm 300 requests pre-chill from sealed system 312, sealed system 312 initiates pre-chill. When pre-chill is complete, defrost begins. Sealed system 312 then waits until the freezer temperature is above an upper set point and then turns on.

More particularly, instead of checking the freezer for a lower set point to be achieved, sealed system 312 runs for a fixed pre-chill time. e.g., two hours, to keep the average temperature in the freezer from warming up too much during the defrost cycle. Upon completion of the two hour pre-chill, sealed system 312 shuts down and defrost algorithm 300 takes over. Defrost algorithm 300 runs defrost heater 196 (shown in FIGS. 2–4) until a termination temperature or a time out occurs. Defrost algorithm 300 then goes into a dwell period (five minutes in an exemplary embodiment) that holds the sealed system and defrost heater 196 off.

Following the dwell period, compressor 272 (shown in FIG. 3) and condenser fan 210 (shown in FIGS. 2–4), in one embodiment, are started for a period of time during which controller 160 keeps evaporator fan 214 (shown in FIGS. 2–4) and fresh food fan 212 (shown in FIGS. 2–4) off and mullion damper 200 (shown in FIGS. 2–4) closed. Once the period ends, or when evaporator temperature achieves a threshold temperature via operation of compressor 272 and condenser fan 210, mullion damper 200 is opened, and evaporator fan 214 and fresh food fan 212 are started in their high speed. Control is then returned to sealed system 312 for normal cooling operation.

Figure 8:
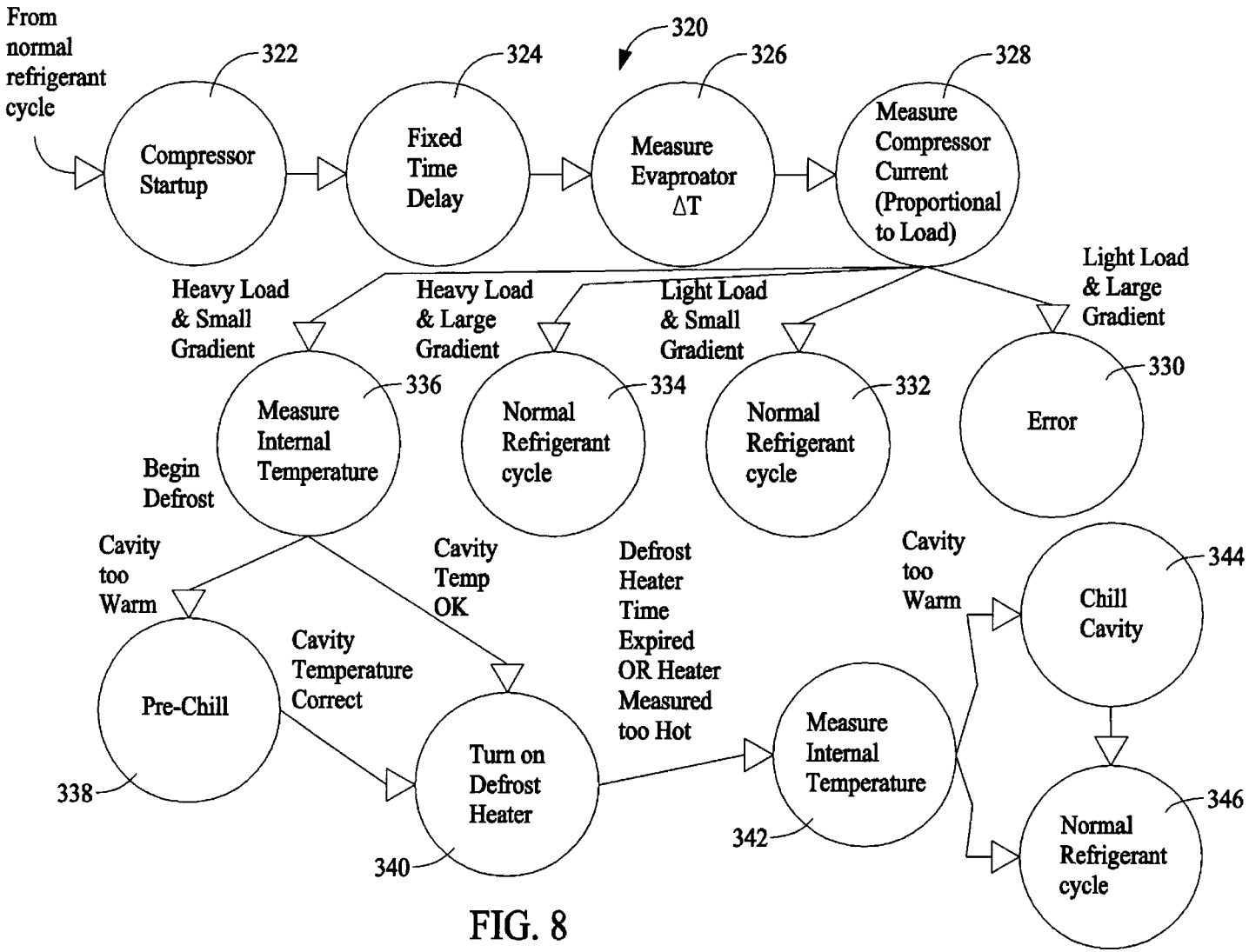
FIG. 8 is a state diagram for sensor based on-demand defrost.

In an alternative implementation of an on-demand defrost system, two temperature sensors (thermistor 248 shown in FIG. 3 and another like thermistor) capable of measuring a temperature differential across the evaporator are utilized in conjunction with a current sensor on the compressor motor, freezer compartment sensor 246, and a state machine algorithm, such as algorithm 320 illustrated in FIG. 8. State algorithm 320 may be used in a stand-alone defrost system or in combination with aspects of state algorithm 300 (shown in FIG. 5), such as, for example, to determine initiation of either the normal or abnormal defrost cycles. A defrost decision can then be made by comparing the relative loads of the evaporator and compressor 272.

A relationship exists between the evaporator and the compressor load such that compressor 272 experiences a largest load when the refrigerant is wholly in a liquid state and must be converted to a gas state. In this instance, liquid refrigerant in the evaporator closest to compressor 272 vaporizes before liquid refrigerant that is farther away from compressor 272, producing a large temperature differential between a first sensor, such as thermistor 248 located on one end of the evaporator close to compressor 272 and a second sensor located on a second end of the evaporator away from compressor 272. Further, when most of the refrigerant is converted, the temperature differential between the ends of the evaporator will reduce because the entire evaporator approaches a substantially uniform temperature (i.e., the vapor temperature of the refrigerant) as the refrigerant is converted.

Therefore, at each refrigerant cycle, when compressor startup is demanded 322, power to compressor 272 is delayed 324 by a fixed predetermined period. Following fixed time delay 324, a temperature differential across the evaporator ($\Delta T$) is measured 326, compressor load current which is proportional to the condenser load is measured 328, and a defrost decision may be made.

If the compressor current indicates a light compressor load and the temperature differential across the evaporator is large, a fault condition is established 330 and an error flag is set.

If the compressor current indicates a light compressor load and the temperature differential across the evaporator is small, most of the refrigerant is vaporized, the system is operating normally, and a normal refrigerant cycle continues to execute 332.

If the compressor current indicates a heavy compressor load and the temperature differential across the evaporator is large, most of the refrigerant is liquified, the system is operating normally, and a normal refrigerant cycle continues to execute 334.

If, however, the compressor current measurement indicates a large compressor load, but the differential temperature measurement across the evaporator is small, it is likely that that frost or ice is causing a uniform temperature gradient across the surface of the evaporator. A need for a defrost cycle is therefore indicated. Before initiating a defrost, a temperature of freezer compartment 104 (shown in FIG. 1) is determined 336. If freezer temperature is at or above a predetermined point, a pre-chill cycle is executed 338 as described above, and defrost heater 196 (shown in FIGS. 2–4) is turned on 340 after the pre-chill cycle completes.

If freezer compartment temperature is below a predetermined point, a pre-chill cycle is not executed, therefore saving energy the pre-chill cycle would have otherwise used, and defrost heater 196 is turned on 340.

In one embodiment, defrost heater 196 is controlled with PID (Proportional, Integral, Derivative) control or other suitable closed loop control to create and execute an optimal heat profile that defrosts the evaporator coils without unnecessarily warming freezer compartment 104, thereby producing further energy savings.

Upon completion of a defrost heater cycle, freezer compartment temperature is again measured to 342 to determine whether a cooling cycle is required for optimal food preservation. If freezer temperature is at or above a predetermined point, sealed system 312 is turned on to lower the temperature of freezer compartment 104, thereby chilling 344 freezer compartment 104. A normal refrigeration cycle is thereafter maintained 346. If, however, freezer temperature is below a predetermined point, a normal refrigeration cycle is maintained 346 without chilling 344 of freezer compartment 102.

In an alternative embodiment, instead of using two temperature sensors to measure the differential temperature across the evaporator, a known thermal time constant of the evaporator is used with a single sensor, such as thermistor 248 on the evaporator. Data acquired from the single sensor, i.e., rate of change data, is combined with the known characteristics of the evaporator coil to determine the temperature differential.

Figure 9:
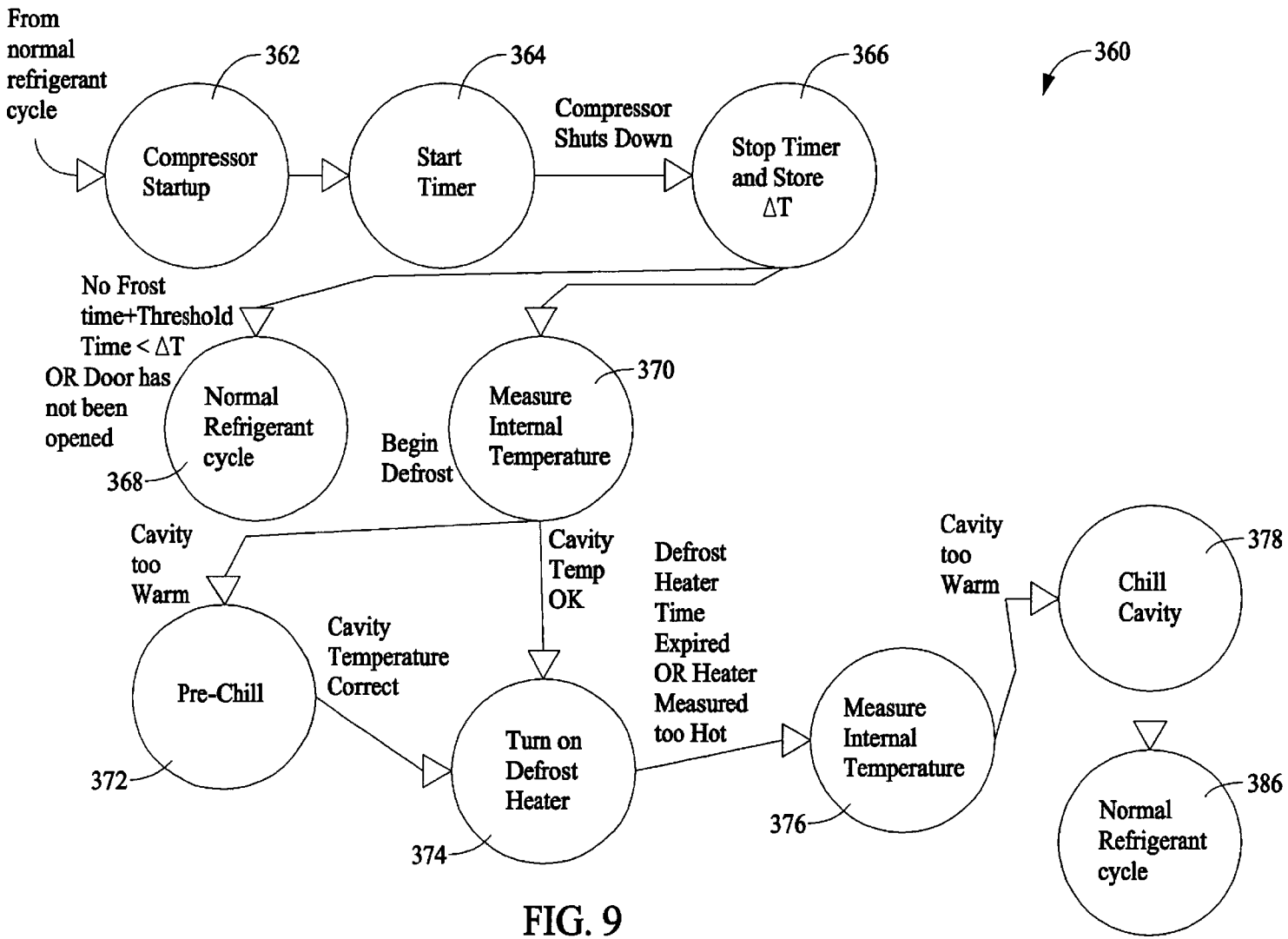
FIG. 9 is a state diagram for implicit defrost control.

Referring to FIG. 9, another defrost system state machine or state algorithm 360 is realized using switches or sensors 242 (shown in FIG. 30) on refrigerator doors 132, 134 (shown in FIG. 1) to determine when the doors are opened, and temperature sensors 244, 246 (shown in FIG. 3) in the cooling cavities or compartments 102, 104. State algorithm 360 may be used as a stand-alone defrost system or in combination with aspects of state algorithm 300 (shown in FIG. 5), such as, for example, to determine initiation of either the normal or abnormal defrost cycles.

In one embodiment, the normal refrigeration cycle measures refrigeration compartment temperature, and more specifically, freezer compartment 104 temperature to determine operation of sealed system 312. When refrigeration compartment temperature rises above a set point, compressor 272 (shown in FIG. 30) is turned on 362 to initiate cooling, and a timer is set 364 to measure elapsed compressor on time. This cooling cycle continues until the refrigeration compartment temperature falls below a lower threshold set point and compressor is shut down. As the compressor is shut down, the timer is stopped and the elapsed compressor run time () is recorded 366 in controller memory.

Two implicit measurements determine whether defrost is required, namely the amount of time that compressor 272 takes to cool the refrigeration compartment and the cumulative amount of time a door 132, 134 has been open since the last defrost cycle. Since frost buildup is a result of humidity entering refrigeration compartments when the doors are open there is no need to expend energy executing defrost cycles if the door has not been opened or has only been opened for a short period of time.

A primary indicator for defrost is the length of time ($\Delta T$) that compressor 272 runs to cool the compartment. If the system measures $\Delta T$ during the first cooling cycle after a defrost cycle, it can be determined if the time to cool the compartment is increasing thereafter. Because $\Delta T$ is a function of compressor load, a threshold time differential $\Delta T_t$ is established during the first cooling cycle that can be used to determine when defrost is required thereafter. In an alternative embodiment, a fixed, pre-programmed $\Delta T_t$ value is employed in lieu of establishing a baseline $\Delta T_t$ during the first cooling cycle.

Thus, when sealed system 312 is shut down and a measured compressor run time $\Delta T_m$ is recorded 366 for that cooling cycle, $\Delta T_m$ is compared to the threshold $\Delta T_t$. If $\Delta T_m$ is less than or substantially equal to $\Delta T_t$, defrost is not needed and a normal cooling cycle continues to execute 368.

If $\Delta T_m$ is greater than the threshold $\Delta T_t$, a need for defrost is indicated. Before initiating a defrost, a temperature of freezer compartment 104 (shown in FIG. 1) is determined 370. If freezer temperature is at or above a predetermined point, a pre-chill cycle is executed 372 as described above, and defrost heater 196 (shown in FIGS. 2–4) is turned on 374 after the pre-chill cycle completes.

Upon completion of a defrost heater cycle, freezer compartment temperature is again measured 376 to determine whether a cooling cycle is required for optimal food preservation. If freezer temperature is at or above a predetermined point, sealed system 312 is turned on to lower the temperature of freezer compartment 104 and chill 378 the freezer compartment. A normal refrigeration cycle is thereafter maintained 380. If, however, freezer temperature is below a predetermined point, a normal refrigeration cycle is maintained 346 without chilling 378 the freezer compartment.

A fail safe maximum door open time to trigger defrost is also included in the event that there have been several door openings, but no increase in cooling time has been measured.

In addition, since door open and cooling times are implicit indicators of a need for defrost, a maximum time between defrost cycles is also maintained as a fail safe mechanism.

Yet another implementation of an on-demand defrost system can be realized using a combination of the embodiments described above. In this embodiment, compressor on time, i.e., ($\Delta T$) is used to determine compressor load instead of using a current sensor on the compressor.

Still yet another implementation of an on-demand defrost system can be realized using any of the hardware scenarios described above but without using a state machine for making defrost decisions. Rather, Fuzzy Logic is used to make defrost decisions. Using Fuzzy inputs of compressor load (CL), evaporator temperature differential (ETD) and compartment temperature (CT) and Fuzzy outputs of defrost required (DR) and pre-chill required (PCD) a rule set can be constructed as follows:

IF CL is Large and ETD is Small THEN DR is Large

IF DR is Large and CT is Large THEN PCD is Large

Since these are Fuzzy variables, they represent continuous overlapping values. This multivariate system produces a weighting factor (DR) that is de-fuzzied using a fuzzy impulse response to determine whether a defrost is required. The PCD variable grows as the time to defrost approaches and pre-chill begins as required. Additional rules may also be used in alternative embodiments in order to optimize defrost operation across multiple refrigerator platforms.

While the invention has been described in terms of various specific embodiments, those skilled in the art will recognize that the invention can be practiced with modification within the spirit and scope of the claims.

What is claimed is:

1. A method for controlling a self-defrosting refrigerator including a compressor, a defrost heater and a controller operatively coupled to the compressor and the defrost heater, said method comprising the steps of:

monitoring a compressor load;

determining whether at least a first defrost cycle is required based on the compressor load;

executing at least one defrost cycle when required; and determining whether a normal defrost interval is required or an abnormal defrost interval is required for a subsequent defrost cycle, each of said normal and abnormal defrost interval having a predetermined value, said normal defrost interval value greater than said abnormal defrost interval value.

2. A method in accordance with claim 1, the refrigerator including an evaporator, said method further comprising the step of monitoring an evaporator load.

3. A method in accordance with claim 2, said step of determining whether at least a first defrost cycle is required comprises the step of comparing the evaporator load and the compressor load.

4. A method in accordance with claim 3 wherein said step of monitoring a compressor load comprises the step of sensing a compressor current.

5. A method in accordance with claim 4 wherein said step of monitoring the evaporator load comprises the step of monitoring a temperature differential across the evaporator.

6. A method in accordance with claim 1 wherein said step of monitoring a compressor load comprises the step of monitoring a compressor run time.

7. A method in accordance with claim 6 wherein said step of determining whether at least one defrost is required comprises the step of comparing the compressor run time to a predetermined compressor run time.

8. A method in accordance with claim 7, said step of monitoring a compressor run time further comprises the step of decrementing the predetermined run time by a predetermined amount for each second of compressor run time.

9. A method in accordance with claim 8, said step of monitoring a compressor run time further comprising the step of decrementing the predetermined run time by a predetermined amount for each second that the door is open.

10. A method in accordance with claim 1, the controller including a memory, said step of determining whether a normal defrost cycle is required or an abnormal defrost is required comprising the steps of:

monitoring an elapsed defrost time to complete a defrost cycle;

storing the elapsed time in controller memory; and comparing the elapsed time to a predetermined reference time.

11. A method in accordance with claim 10 wherein said step of executing at least one defrost cycle comprises the steps of:

executing a first defrost cycle when the elapsed time is less than the reference time; and executing a second defrost cycle when the elapsed time is greater than the reference time, said second defrost cycle different than said first defrost cycle.

12. A method in accordance with claim 1, the refrigerator including at least one refrigeration compartment, said step of regulating the defrost cycle comprising the steps of:

determining a temperature of the refrigeration compartment, and executing a pre-chill cycle only when the determined temperature is above a predetermined temperature.

13. A method in accordance with claim 1 wherein said step of regulating the defrost cycle comprises the steps of:

monitoring an evaporator temperature during defrost; and terminating the defrost when the evaporator reaches a predetermined temperature.

14. A method in accordance with claim 1, the refrigerator including a refrigeration compartment, the controller including a memory, the memory containing a time till defrost value and a refrigeration compartment temperature setpoint, said step of regulating the defrost comprising the steps of:

reading the time till defrost and the refrigeration compartment temperature setting upon powerup;

determining the temperature of the refrigeration compartment; and resuming the time till defrost if the determined temperature is substantially at the refrigeration compartment temperature setting.

15. A method in accordance with claim 1, the refrigerator including a refrigeration compartment, the controller including a memory, the memory containing a refrigeration compartment temperature setpoint, said step of regulating the defrost cycle comprising the steps of:

determining the temperature of the refrigeration after the defrost is completed;

comparing the determined temperature to the compartment temperature setpoint; and executing a cooling cycle only when the determined temperature exceeds the compartment temperature setpoint.

16. A method in accordance with claim 1 wherein said step of determining whether at least a first defrost cycle is required comprises the step of determining a need for a defrost cycle using fuzzy inputs.

17. A defrost control system for a frost-free refrigerator including a compressor, a defrost heater, at least one refrigeration compartment and a temperature sensor thermally coupled to the refrigeration compartment, said control system comprising:

a controller operatively coupled to the compressor, the defrost heater, and the temperature sensor, said controller configured to:

monitor a compressor load;

determine whether at least a first defrost cycle is required based on the compressor load;

execute at least one defrost cycle when required; and determine, for a subsequent defrost cycle, whether a normal defrost cycle corresponding to a first predetermined defrost interval or whether an abnormal defrost cycle corresponding to a second predetermined defrost interval is required for the subsequent defrost cycle.

18. A defrost control system accordance with claim 17, the refrigerator including an evaporator, said controller further configured to monitor an evaporator load.

19. A defrost control system in accordance with claim 18, said controller further configured to compare the evaporator load and the compressor load.

20. A defrost control system in accordance with claim 19 said controller further configured to monitor a compressor load by sensing a compressor current.

21. A defrost control system in accordance with claim 20, said controller further configured to monitor a temperature differential across the evaporator.

22. A defrost control system in accordance with claim 17, said controller further configured to monitor a compressor run time.

23. A defrost control system in accordance with claim 22, said controller further configured to compare the compressor run time to a predetermined compressor run time.

24. A defrost control system in accordance with claim 23, said controller further configured to decrement the predetermined run time by a predetermined amount for each second of compressor run time.

25. A defrost control system in accordance with claim 24, said controller further configured to decrement the predetermined run time by a predetermined amount for each second that the door is open.

26. A defrost control system in accordance with claim 17, said controller comprising a memory, said controller further configured to:

monitor an elapsed defrost time to complete a defrost cycle;

store the elapsed time in said controller memory; and compare the elapsed time to a predetermined reference time.

27. A defrost control system in accordance with claim 26, said controller further configured to:

execute a first defrost cycle when the elapsed time is less than the reference time; and execute at least a second defrost cycle when the elapsed time is greater than the reference time, said second defrost cycle different than said first defrost cycle.

28. A defrost control system in accordance with claim 17, said controller further configured to determine a temperature of the refrigeration compartment, and execute a pre-chill cycle only when the determined temperature is above a predetermined temperature.

29. A defrost control system in accordance with claim 17, said controller further configured to:

monitor an evaporator temperature during defrost; and terminate the defrost when the evaporator reaches a predetermined temperature.

30. A defrost control system in accordance with claim 17, said controller comprising a memory, said memory containing a time till defrost value and a refrigeration compartment temperature setpoint, said controller further configured to:

read the time till defrost and the refrigeration compartment temperature setting upon powerup;

determine the temperature of the refrigeration compartment; and resume the time till defrost if the determined temperature is substantially at the determined temperature.

31. A defrost control system in accordance with claim 17, said controller comprising a memory, said memory containing a refrigeration compartment temperature setpoint, said controller further configured to:

determine the temperature of the refrigeration after the defrost is completed;

compare the determined temperature to the compartment temperature setpoint; and execute cooling cycle only when the determined temperature exceeds the compartment temperature setpoint.

32. A defrost control system in accordance with claim 17 said controller further configured to determine a need for a defrost cycle using fuzzy inputs.

* * * * *